US005876182A

United States Patent [19]

Schulte

[11] Patent Number: 5,876,182

[45] Date of Patent: Mar. 2, 1999

[54] APPARATUS AND METHOD FOR PREVENTING LAMINAR BOUNDARY LAYER SEPARATION ON ROTOR BLADES OF AXIAL TURBOMACHINERY

[75] Inventor: Volker Schulte, Berlin, Germany

[73] Assignee: BMW Rolls-Royce GmbH, Oberusel, Germany

[21] Appl. No.: 907,478

[22] Filed: Aug. 11, 1997

[30] Foreign Application Priority Data

Aug. 9, 1996 [DE] Germany ..... 196 32 207.3

[51] Int. Cl.[6] ..... F01D 5/14; F03B 13/04

[52] U.S. Cl. ..... 415/115; 415/904

[58] Field of Search ..... 415/115, 116, 415/914; 416/90 R, 97 R, 96 R

[56] References Cited

U.S. PATENT DOCUMENTS 4,581,887 4/1986 Scheffler et al. ..... 415/116 X
5,397,217 3/1995 DeMarche et al. ..... 415/115 X

OTHER PUBLICATIONS

"Unsteady Wake–Induced Boundary Layer Transition in High Lift LP Turbines," by Volker Schulte and Howard P. Hodson, ASME–Paper 96 GT 486, published at IGTI Conference in Birmingham on Jun. 11, 1996, accepted for publication the Journal of Turbomachinery.

*Primary Examiner*—John E. Ryznic
*Attorney, Agent, or Firm*—Evenson, McKeown Edwards & Lenahan, PLLC

[57] ABSTRACT

The boundary layer stimulation by blowing flow fluid into the proximity of the separation region on turbine blades is disclosed. In order to prevent a laminar boundary layer separation, the blowing-in takes place in the form of intermittent fluid pulses. A particularly advantageous arrangement for an axial turbomachinery rotor disk is provided for this purpose, on the end face of which a stationary ring is provided which has at least one passage opening with which inlet openings for the blade fluid ducts which are provided in the disk which passes by and by way of which the blowing into the proximity of the separation region takes place, become periodically congruent.

8 Claims, 1 Drawing Sheet

APPARATUS AND METHOD FOR PREVENTING LAMINAR BOUNDARY LAYER SEPARATION ON ROTOR BLADES OF AXIAL TURBOMACHINERY

BACKGROUND AND SUMMARY OF THE INVENTION

This application claims the priority of German application 196 32 207.3 filed in Germany on Aug. 9, 1996, the disclosure of which is expressly incorporated by reference herein.

The invention relates to axial turbomachinery having at least one rotor disk carrying several blades, in which case, for preventing the laminar boundary layer separation on the surfaces of the blades or airfoils, a flow fluid in the form of intermittent fluid pulses can be blown into the proximity of the separation area by way of fluid ducts which are provided in the blades and lead into blow-out openings on the blade surface. Concerning the known state of the art, reference is made particularly to German Patent Document DE 43 33 865 C2. The state of the art is also known from ASME-Paper 96-GT-486 with the lecture "Unsteady Wake-Induced Boundary Layer Transition in High Lift LP Turbines" presented by V. Schulte and H. P. Hodson at the IGTI Conference in Birmingham 1996, in which so-called "calmed zones" are mentioned which can be observed in boundary layers on the blading of turbo-engines.

The relative movement of rotors and stators in turbo engines causes the so-called wakes of the upstream blade row to interact with the boundary layers of the blade profiles of the blade row situated downstream. In comparison to the undisturbed inflow, this may result in various changes of the boundary layer development and thus of the profile losses. When the passing (unsteady) wakes impact on a predominantly laminar or separated profile boundary layer, as occurs frequently, for example, on the suction side of low-pressure turbines at low Reynold's numbers, the position of the transition start on the suction side will periodically move towards to the blade leading edge. This is caused by the increased turbulence intensity inside the wake fluid. It can be observed experimentally (compare the above-mentioned literature) that a fixed position on the blade surface first has a turbulent zone, which is at first followed by a so-called calmed zone and only then will the boundary layer return to its original undisturbed condition. In this case, the so-called calmed zone is a virtually laminar zone since no turbulent fluctuation quantities occur in it, however, the wall shear stress slowly releases back from a turbulent value back to a laminar value. The calmed zone is therefore a purely unsteady phenomenon which can occur only in boundary layers which undergo periodically unsteady transition. The wall shear stress which is increased in comparison to a "normal" laminar boundary layer therefore stabilizes the calmed zone so that the separation and transition process are delayed in the calmed zone.

These so-called calmed zones are therefore a special unsteady boundary layer phenomenon which offers the advantageous possibility of preventing a laminar separation, for example, on the suction side of low-pressure turbines without tripping the boundary layer to become completely turbulent. As a result the stability of the boundary layer is increased in comparison to the completely laminar boundary layer and the losses are lower compared to a fully turbulent boundary layer. In low-pressure turbines, the laminar separation bubble, which may not reattach, at low Reynold's numbers, represents a risk for the efficiency and a limit for the achievable aerodynamic blade loading. Currently, the control of this separation bubble is difficult and in the state of the art known so far can essentially take place only by way of the shaping of the blades.

Since the just described calmed zones have a loss-reducing effect, while the turbulent zones induced by the wakes have the tendency to increase the losses, it is endeavored to generate such calmed zones by suitable measures in order to be able to suppress high-loss laminar separation bubbles in the most efficient way.

Thus, it is known that the advantageous calmed zones can be generated by targeted active boundary layer measures. In the state of the art, a boundary layer stimulation is known for preventing separation bubbles, specifically by blowing flow fluid into the separation region by way of fluid ducts which are provided in the blades and lead out at the blade surface (compare German Patent Documents DE 30 43 567 C2 and DE 35 05 823 A1).

However, these are quasi-steady measures.

Furthermore, it is known from the above-mentioned German Patent Document DE 43 33 865 C1 to take steady measures for this purpose in that the blowing-in takes place in the form of intermittent fluid pulses which has the result that the boundary layer does not become fully turbulent but only intermittently turbulent and intermittently calmed. In comparison to steady measures, this generates significantly lower losses because, with respect to the generating of losses, the calmed boundary layer can be equated with a laminar boundary layer.

In German Patent Document DE 43 33 865 C1, a valve constructed as an oscillatory leaf spring is provided for generating the intermittent fluid pulses in each blade or in each blade plate of the turbo-engine, which valve periodically opens and closes the fluid ducts leading out at the blade surface, by way of which fluid ducts the flow fluid is blown into the boundary layer. This quasi-timed valve therefore generates the desired fluid pulses.

Although this known solution can be implemented theoretically in a basically also reliable manner, this measure cannot be used as a practical matter due, at least in part, to the requirement of a plurality of such timed valves on a rotor disk with a plurality of turbo-engine blades.

It is an object of the present invention to provide a solution which is simplified in this respect and by means of which fluid pulses can be generated on a rotor disk of a turbo-engine carrying rotor blades in a manner which is suitable for a practical application, that is, can easily be implemented technically.

For achieving this object, it is provided that a stationary ring having at least one passage opening is provided on an upstream facing side of the rotor disk, with which the inlet openings for the blade fluid ducts provided in the disk passing by become periodically congruent. From a space situated in front of the rotor disk, flow fluid intermittently enters the fluid ducts as fluid pulses by way of the at least one passage opening.

In contrast to the formation by unsteady wakes, the generating of the calmed zones according to the invention permits by means of active measures to optimize the frequency of the boundary layer stimulation as well as their position with respect to lowest losses. The fluid pulses which are blown intermittently into the separation region for the intermittent boundary layer stimulation lead to an only short-term influencing of the boundary layer on the blade surface and, considered separately, represent a negligibly low rate of flow. The invention can be used in a preferred manner at very low Reynold's number and, in particular, can be provided first in low-pressure turbines. There it is possible by means of this invention to expand the operating range of conventional blade profiles to even lower Reynold's numbers, or to use high-lift profiles which without the use of the present invention have an unacceptable efficiency because of an excessive separation which may not reattach. The use of high-lift profiles has clear weight and cost advantages because it permits a general reduction of the number of blades.

The blow-in frequency of the intermittent fluid pulses can be optimized preferably with respect to the aerodynamic design aspect of the turbo-engine. In this case, the blow-in frequency may be in the order of magnitude of the blade passing frequency of a rotor or stator disk carrying the blades.

The arrangement on an axial turbomachinery rotor disk according to the invention, which is described in the following and is illustrated in the drawings can be implemented without a special control and with low additional expenditures, in which case, for preventing the laminar boundary layer separation on the blades, a flow fluid in the form of intermittent fluid pulses can be blown into the proximity of the separation region by way of fluid ducts which are provided in the blades and lead into blow-out openings on the blade surface.

Other objects, advantages and novel features of the present invention will become apparent from the following detailed description of the invention when considered in conjunction with the accompanying drawings.

DETAILED DESCRIPTION OF THE DRAWINGS

Figure 1:
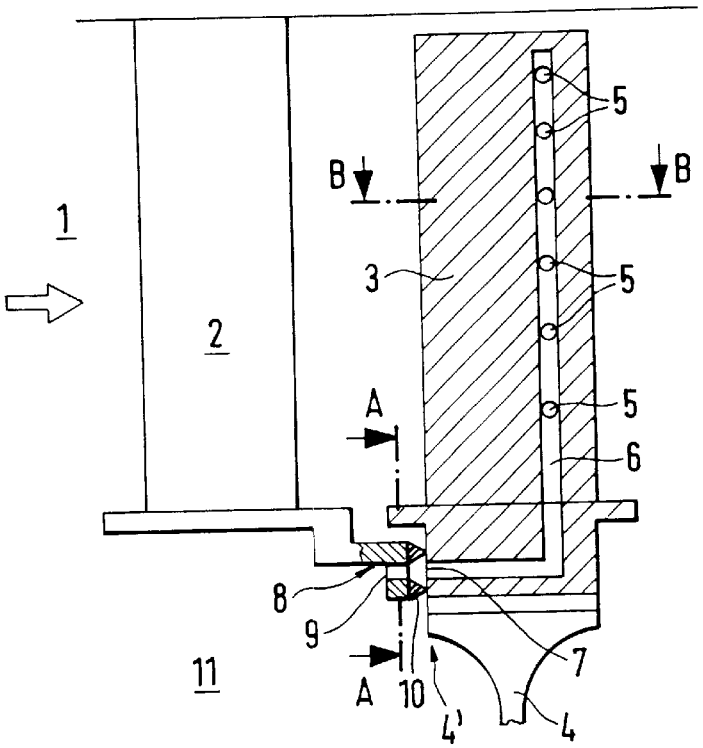
FIG. 1 is a schematic part sectional view of a turbine assembly including a blade of a turbine rotor with a stator blade situated upstream thereof, constructed according to a preferred embodiment of the invention.

In a flow duct 1 of a turbo engine, through which the flow takes place in the direction of the arrow, stator blades 2 are arranged in a conventionally ring-shaped manner and in the process form a so-called stator disk, one of the stator blades 2 being shown in FIG. 1. Downstream of this stator blade 2, a rotor blade 3 is illustrated, several of these rotor blades 3 also being arranged in a ring-shaped manner on a turbo-engine rotor disk 4. On the surface of the blades 3, blow-out openings 5 are provided on the blade suction side and are connected with a fluid duct 6 which extends within the blade 3. Each fluid duct 6 of a rotor blade 3 is continued in the rotor disk 4 and extends to the upstream side 4' of the rotor disk where it leads out in the form of an inlet opening 7.

In the flow direction against the blades 3, a stationary ring 8 is situated in front of the side 4' of the rotor disk 4, which stationary ring 8 has at least one passage opening 9, and preferably several passage openings 9 which are distributed along its circumference, above and below which one seal 10 respectively is provided toward the rotor disk 4. The total pressure, which exists in the space 11 between the shown rotor disk 4 and the rotor disk which is not shown and is situated upstream thereof in the flow direction, is higher than the static pressure applied in the area of the blow-out opening 5. This has the result that, at the point in time at which the inlet opening 7 of the rotor disk 4 passing by the stationary ring 8 becomes congruent with a passage opening 9 in the stationary ring, a brief fluid pulse of the flow fluid situated in the space 11 can reach the corresponding fluid duct 6. This fluid pulse is then continued in the fluid duct 6 toward the outlet openings 5. By way of these outlet openings 5 the fluid pulses arrive on the blade surface and there causes the described active boundary layer stimulation. Since, because of the passing-by of the rotor disk 4 at the passage opening 9, congruent location of the respective passage openings 9 with the respective inlet openings 7 lasts only for a very short time and thus only the desired brief fluid pulse is in fact generated. Because of the relative movement of the inlet opening 7 with respect to the passage opening 9, by means of a frequency which is a function of the rotational speed of the rotor disk 4 as well as of the number of passage openings 9 in the stationary ring, an intermittent air entry into the fluid duct 6 is therefore facilitated. In this case, the duration of the fluid pulse depends on the size of each passage opening 9, particularly in the circumferential direction.

Figure 2:
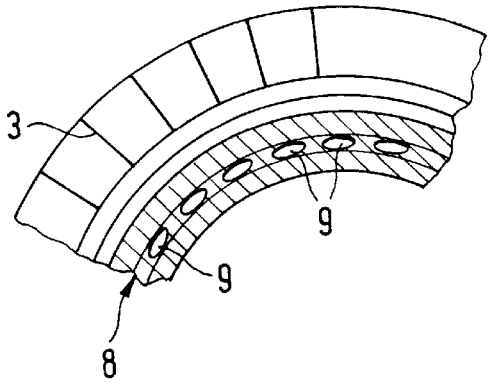
FIG. 2 is a partial view along section A—A from FIG. 1.
Figure 3:
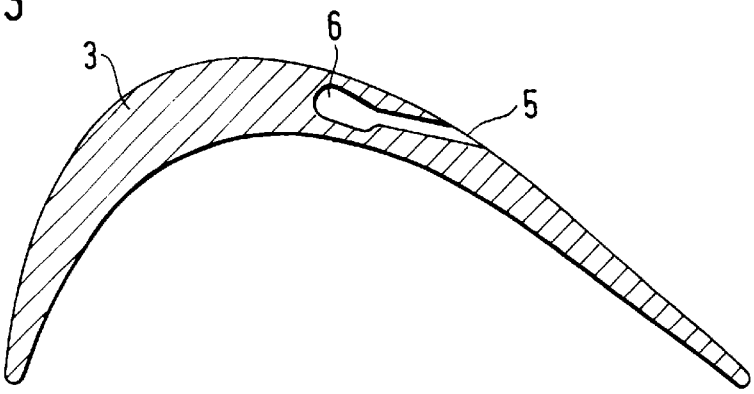
FIG. 3 is a sectional view along section B—B from FIG. 1.

As mentioned above, several passage openings 9 may be provided on the stationary ring 8, which are distributed along its circumference in order to generate the desired frequency of the intermittent fluid pulses. These several passage openings 9 are also shown in FIG. 2. Like the number of these passage openings 8, the number of blow-out openings 5 as well as their position can be optimized with respect to the desired results. However, these blow-out openings 5 are expediently provided in an essentially radially extending row corresponding to the fluid duct 6 extending essentially in the radial direction with a precisely defined pitch and diameter at a precisely defined axial position. A plurality of modifications of the shown embodiment are contemplated according to the invention.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Axial turbomachinery having at least one rotor disk carrying several blades, a flow fluid in the form of intermittent fluid pulses being blowable into the proximity of a flow separation area of the blade by way of blade fluid ducts which are provided in the blades and lead into blow-out openings on the blade surface for preventing the laminar boundary layer separation on the blades, wherein a stationary ring is provided on an axial end side of the rotor disk which has at least one passage opening communicating with a pressurized fluid space, said at least one passage opening being periodically aligned with respective inlet openings for the blade fluid ducts provided in the passing-by disk, thereby intermittently supplying the fluid as fluid pulses to the blade fluid ducts by way of the at least one passage opening.

2. Axial turbomachinery according to claim 1, wherein at least one of the size and the number of the passage openings in the stationary ring is designed in view of a desired blow-in frequency of the intermittent fluid pulses.

3. Axial turbomachinery according to claim 1, wherein the blow-in frequency is of the order of magnitude of the blade passing frequency of a rotor disk or stator disk and is optimized with respect to the aerodynamic design point of the turbomachinery.

4. Axial turbomachinery according to claim 2, wherein the blow-in frequency is of the order of magnitude of the blade passing frequency of a rotor disk or stator disk and is optimized with respect to the aerodynamic design point of the turbo-engine.

5. Axial turbomachinery assembly comprising:

a rotatable rotor disk carrying a rotor blade, a blade fluid channel in said rotor blade which opens to a plurality of blow out openings along the rotor blade, said blade fluid channel having an inlet opening at an axial end face side of the rotor disk, a pressurized fluid source, and a ring with at least one fluid supply opening which is communicated with said fluid source and which is periodically aligned with said inlet opening during relative rotation of the ring and rotor disk during operation of the turbo machinery assembly, thereby providing pulsating fluid flow through said blade fluid channel and blow out openings which prevents laminar boundary layer separation on the blade during said operation.

6. Turbomachinery assembly according to claim 5, wherein a plurality of said rotor blades are carried by the rotor disk which each include corresponding blade fluid channels and blow out openings, wherein said ring includes a plurality of circumferentially spaced ones of said fluid supply openings which are periodically aligned with respective ones of said fluid channel inlet openings during operation of the turbomachinery assembly.

7. Turbomachinery assembly according to claim 6, wherein said ring is a fixed ring disposed at an upstream end side of said rotor disk with respect to flow through said blades.

8. A method of operating an axial turbomachinery assembly of the type comprising:

a rotatable rotor disk carrying a rotor blade, a blade fluid channel in said rotor blade which opens to a plurality of blow out openings along the rotor blade, said blade fluid channel having an inlet opening at an axial end face side of the rotor disk, a pressurized fluid source, and a ring with at least one fluid supply opening which is communicated with said fluid source and which is configured to be periodically aligned with said inlet opening during relative rotation of the ring and rotor disk during operation of the turbo-engine assembly, said method including automatically providing pulsating fluid flow through said blade fluid channel and blow out openings by relative rotation of the rotor disk and ring to thereby prevent laminar boundary layer separation on the blade during said operation.

* * * * *